United States Patent [19]

Breitung, II

[11] Patent Number: 4,941,136

[45] Date of Patent: Jul. 10, 1990

[54] PROGRAMMABLE HOUR METER FOR RECORDING ELAPSED OPERATION TIME

[75] Inventor: Edward J. Breitung, II, Springfield, Ill.

[73] Assignee: Stewart Warner Corporation, Chicago, Ill.

[21] Appl. No.: 243,919

[22] Filed: Sep. 13, 1988

[51] Int. Cl.[5] ..... G04F 8/00

[52] U.S. Cl. ..... 368/8; 368/5; 371/66

[58] Field of Search ..... 368/5, 8; 371/66

[56] References Cited

U.S. PATENT DOCUMENTS

| | | | |
|---|---|---|---|
| 2,604,940 | 7/1952 | Heptinstall | 368/5 |
| 3,758,756 | 9/1973 | Johns | 368/8 |
| 4,501,005 | 2/1985 | Miller | 368/8 |
| 4,630,292 | 12/1986 | Juricich et al. | 368/8 |
| 4,701,858 | 10/1987 | Stokes et al. | 371/66 |
| 4,951,782 | 5/1986 | Germer | 371/66 |

FOREIGN PATENT DOCUMENTS

| | | | |
|---|---|---|---|
| 2728032 | 11/1979 | Fed. Rep. of Germany | 368/5 |
| 618541 | 2/1949 | United Kingdom | 368/8 |

*Primary Examiner*—Bernard Roskoski

*Attorney, Agent, or Firm*—Lorusso & Loud

[57] ABSTRACT

A completely electronic programmable hour meter is disclosed. The hour meter accumulates and displays run time of the device being measured. The hour meter can also count pulses. The meter can be preprogrammed with a maintenance timer limit which is compared to the accumulated run time. If the accumulated run time equals or exceeds the preprogrammed time limit an alarm display flashes. The hour meter will store the accumulated run time for up to 5 years if power is interrupted. This memory retention occurs without use of a battery. The elapsed time is stored in a plurality of registers such that no register is written to more than a preselected number of times, nominally ten thousand, until all the registers have been updated the preselected number of times.

12 Claims, 5 Drawing Sheets

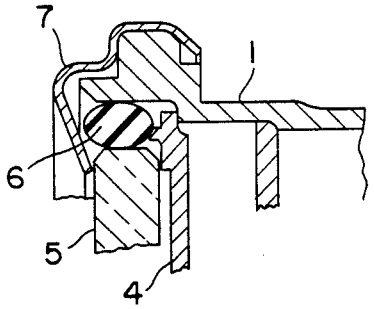
FIG. 3
FIG. 4
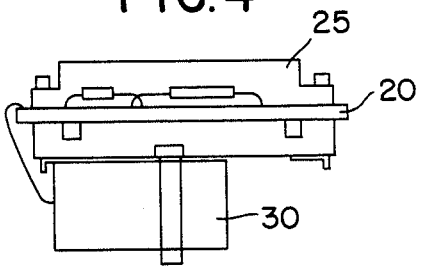
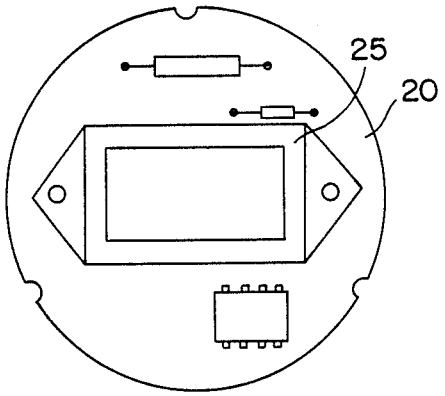
FIG. 5

PROGRAMMABLE HOUR METER FOR RECORDING ELAPSED OPERATION TIME

BACKGROUND OF THE INVENTION

The present invention relates in general to an engine operation recorder and is more specifically concerned with an improved apparatus for recording the total actual operating time of a machine and comparing this total with a preprogrammed limit. If the total operating time exceeds the preprogrammed limit an indicator light flashes thereby notifying the operator that certain maintenance procedures need to be performed.

In many instances it is critical to know the number of hours a machine or motor has been operating since it last underwent routine maintenance. In some industries, specifically airlines, routine maintenance must be performed at set intervals. Timers either electronic, mechanical or a combination thereof have been used to measure the operation run time of a machine. These hour meters have certain drawbacks. Mechanical timers create noise from the moving gears. Electrical timers are subject to memory loss upon power failure and battery backup of these electric timers has proved to be expensive and not completely reliable. Many of these timers were not able to store a preset value and notify the maintenance personnel that certain maintenance needed to be performed. The present invention solves many of these problems and will be better understood from the description that follows.

SUMMARY OF THE INVENTION

The present invention concerns a programmable hour meter. The meter is completely electronic, eliminating all moving parts. The meter operates in one of two modes, it can be configured to accumulate hours or it can be configured to count pulses.

In the hour mode the meter accumulates and displays the run time of the device being measured. In this mode the meter can be configured to display up to 9999.9 hours or 99999.0 hours. The least significant digit is one tenth of an hour if in the first display mode and one hour if in the second display mode. The meter can be preprogrammed to store a maintenance timer limit. The meter while operating and accumulating run hours continuously compares the preprogrammed limit with the accumulated hours. If the accumulated hours equals or exceeds the preprogrammed limit an alarm display flashes. If it is desired the alarm indicator can be attached to an alarm annunciator to produce a warning sound or illuminate an indicator light.

In the pulse counter mode, the meter is configured to accumulate pulses and display pulses counted. The pulse counter input is scanned in one millisecond intervals. If the input is in the high state for 16 successive scans, the pulse is recognized as high. If the input is in the low state for 16 successive scans, the pulse is recognized as low. One pulse will be accumulated for each recognized high-to-low transition.

In either operating mode memory of the accumulated hours or pulses is retained should there be a power failure. The memory is stored in an $E^2$PROM and power is supplied by a capacitor. The memory is retained for at least 5 years without power.

An object of the present invention is to provide an all electronic hour meter with an LCD display.

It is a further object of the present invention to provide an all electronic hour meter that retains its memory without batteries.

Yet another object of the present invention is to provide a warning mechanism when the hour meter has exceeded a preset limit.

Still another object of the present invention is to provide an hour meter that will withstand severe environmental conditions that occur in industrial work settings.

Other objects and features of the invention will become apparent on examination of the drawings and descriptions and claims of the specification.

BRIEF DESCRIPTION OF THE DRAWINGS

FIG. 3 shows a cut away view of area circled in FIG. 2.

FIG. 4 is a side view of the hour meter of the present invention.

FIG. 5 is a front view of the hour meter of the present invention.

DESCRIPTIONS OF PREFERRED EMBODIMENTS

Figure 1:
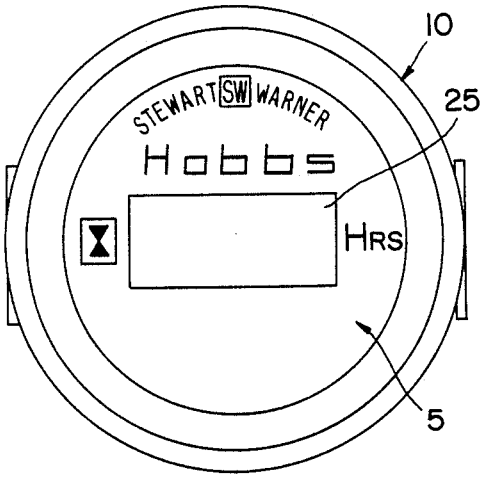
FIG. 1 shows the display face of the hour meter.
Figure 2:
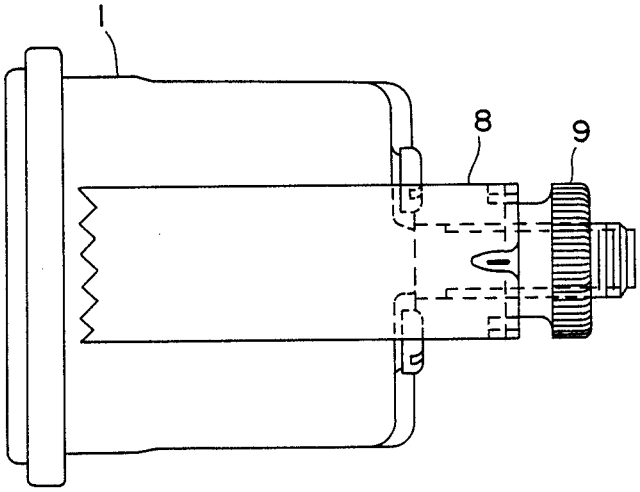
FIG. 2 shows a side view of the housing of the present invention.

Referring to FIGS. 1–3, the hour 10 meter of the present invention is shown. The hour meter has an overall outside enclosure mounting diameter of 2 inches to conform with the standard dimensions on existing hour meter enclosures. The LCD (liquid crystal display) 25 is visible through the faceplate 5 of the enclosure 1. The face plate 5 is secured to the enclosure 1 through the pressure of the circular retaining clip 7 and the dial plate 4. O-ring 6 forms a water tight seal with the enclosure 1 and the face plate 5. The dial plate 4 is provided with an opening through which the accumulated run time is displayed.

FIGS. 4 and 5 show the preferred embodiment of present invention. FIG. 4 shows a side view of the circuit board 20, LCD 25 and capacitor 30 of the present invention. The LCD 25 fits securely into the opening in the dial plate 4 (shown in FIG. 1). The construction shown allows one to easily replace existing hour meters with the hour meter of the present invention.

Figure 6:
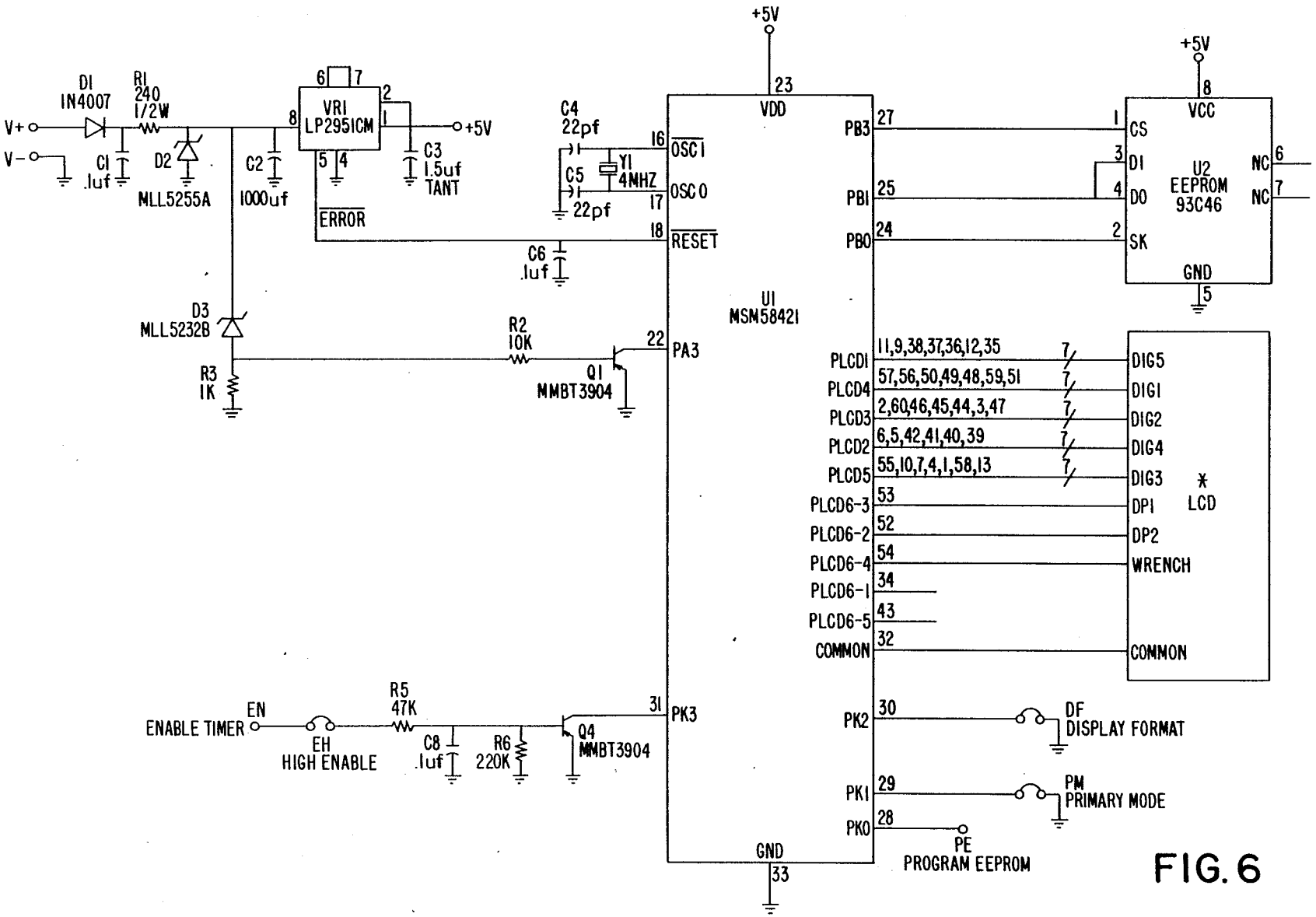
FIG. 6 is a schematic of the electronic circuit board of the present invention with positive enable.

FIG. 6 shows a schematic diagram of the electronic timing mechanism of the present invention. This schematic represents positive power enable for enabling the circuit. Either DC or AC power may be used as the source to operate the hour meter. Power is supplied through power leads V+ and V− as shown in FIG. 6. A 1000F capacitor C2 supplies back up power should the external power be interrupted. On an occurrence of power down, the elapsed time is stored in the $E^2$PROM, 93C46, of the circuit board.

Figure 7:
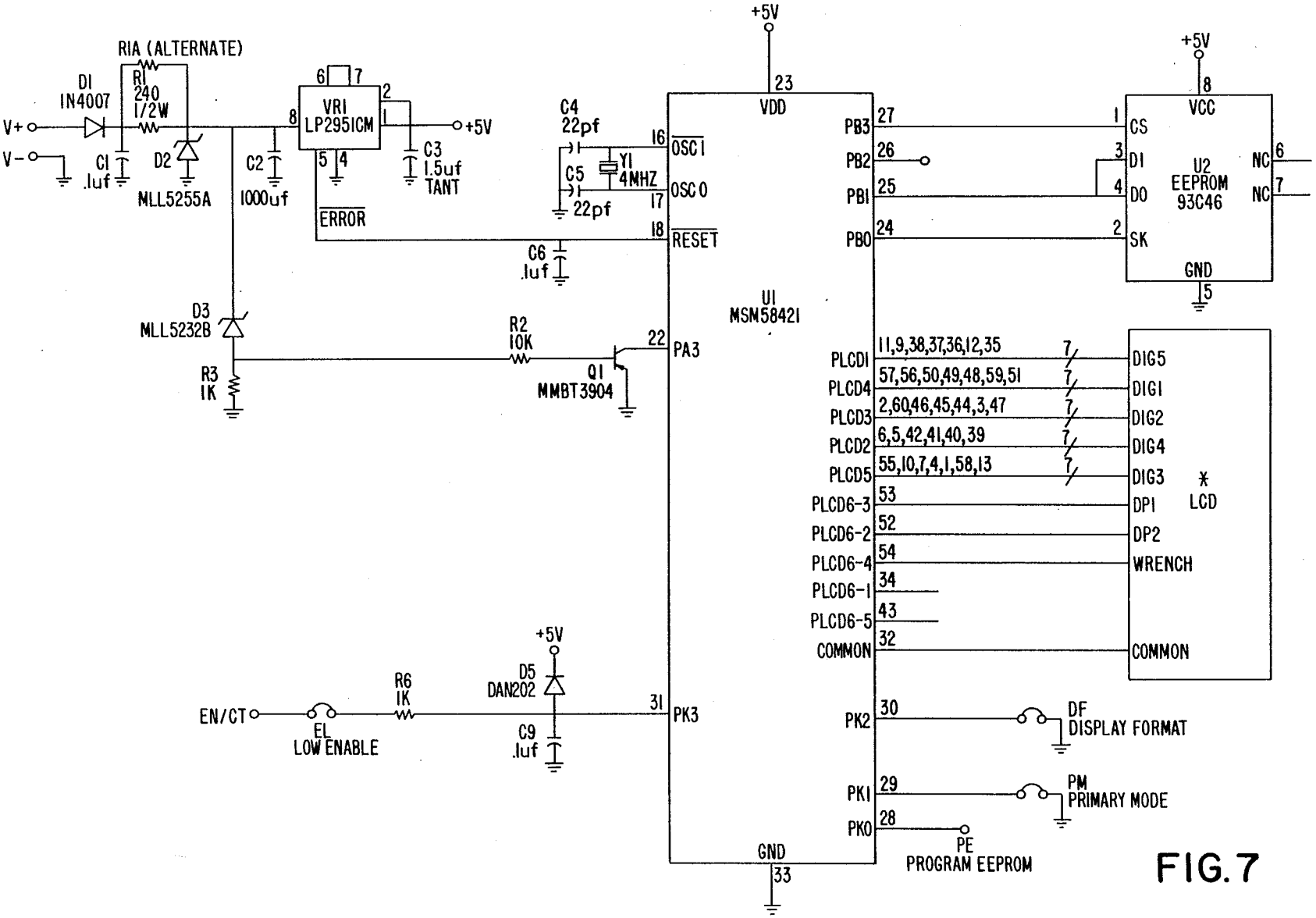
FIG. 7 is a schematic of the electronic circuit board of the present invention with negative enable.

FIG. 7 shows a schematic similar to FIG. 6 except that the circuit is enabled by negative power.

Figure 8:
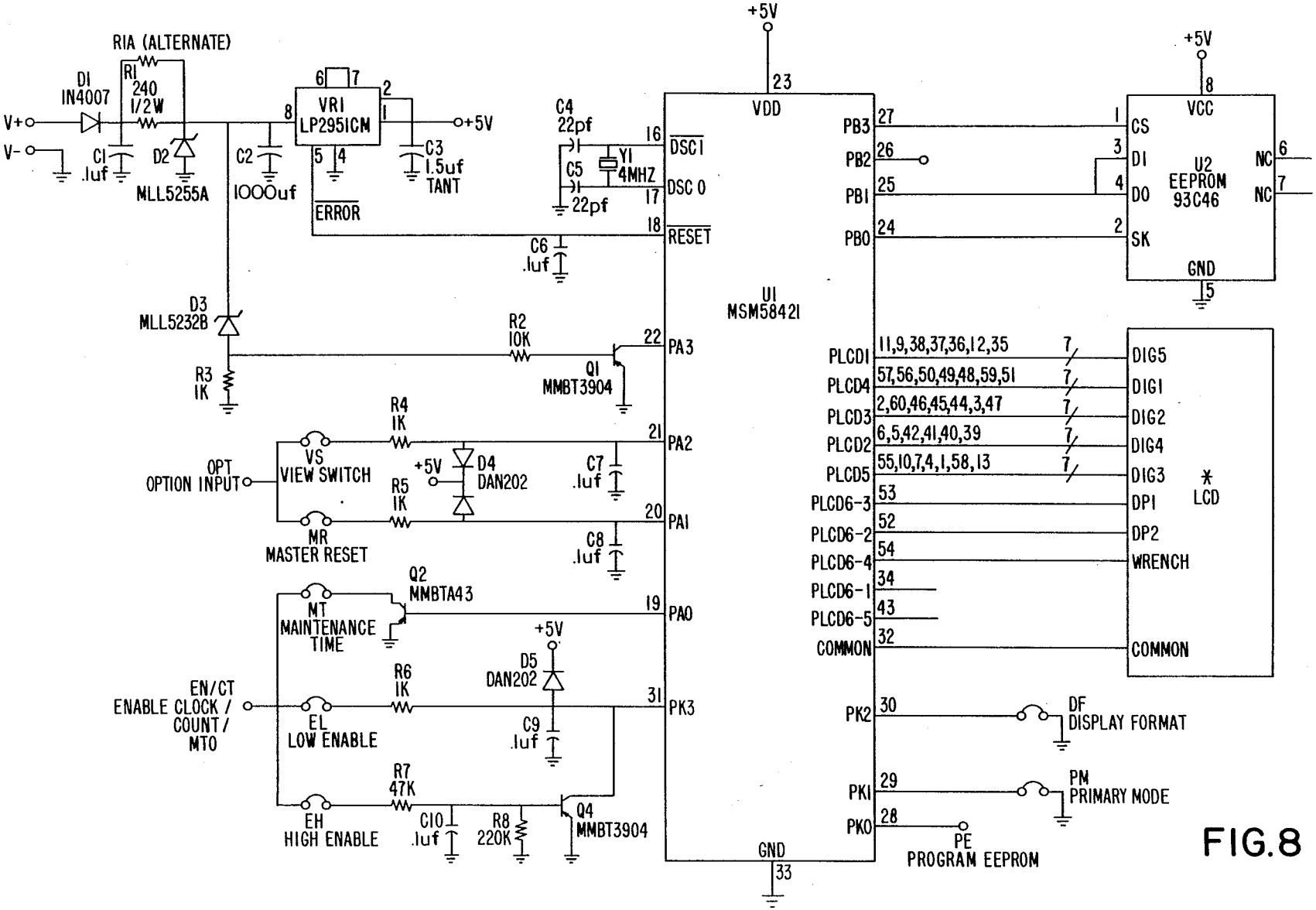
FIG. 8 is a schematic of the electronic circuit board of the present invention with jumper options to make all possible configurations.

FIG. 8 shows a circuit which is enabled through negative or positive power depending on jumpers EL and EH.

In many computer devices memory is stored in RAM (random access memory). This method is effective, but it requires constant power. On a loss of power to RAM, all information stored in RAM is lost.

A second way to store memory is in a $E^2$PROM. These devices require no power once memory is written into one of its registers. However, $E^2$PROMs are warranted for set number of writes per register. Thus, after a certain amount of use, that is, approximately 10,000 writes to a register, the register of $E^2$PROM becomes unreliable. In effect, the $E^2$PROM wears out. Although 10,000 writes to a register may sound like a long period of use, these $E^2$PROM are being written to constantly in applications where time is continually being updated.

An important feature of the hour meter of the present invention is the computer program stored in the microcontroller, U1, of the circuit board. The program extends the life the $E^2$PROM by storing the elapsed time in the following way. Instead of just writing to one register to store the elapsed time, the program writes to one register and after a certain amount of writes the program goes to the "next" register and begins to write to that register. In this manner the life of the $E^2$PROM is extended. It also allows the hour meter to be backed up with the power from a capacitor rather than a backup battery. The capacitor supplies adequate power to write the elapsed time to a register when power fails. The use of all the registers of the $E^2$PROM through the computer program extends the life of the $E^2$PROM so that it will last as long as any other component in the hour meter of the present invention.

Another feature of the computer program is that it only updates the registers when they change. The elapsed time is stored in two sixteen bit words. The first word stores the four most significant digits of the elapsed time while second word stores the 4 least significant digits, 3 of which are not displayed. The first word is stored only when it changes, that is, only when the fourth most significant digit changes, therefore, a minimum of writes are required. This feature also helps extend the life of the $E^2$PROM. This design of the hour meter allows the hour meter to retain memory for 5 years or more. This data retention is accomplished without the use of a battery. Appendix A is a listing of the computer program in assembly language and is incorporated by reference herein.

Another feature of the hour meter of the present invention is the ability to count pulses rather than record elapsed time. Input 29 (FIGS. 6–8) determines the primary operating mode of the present invention.

The hour meter of the present invention contains a display format option. The display format is determined continuously by the state of the display format input (Input 30 FIGS. 6–8). All of the pixels of the display are turned on for approximately one second upon power up, as a display test is run. In display format one the display has 5 seven-segment digits with a decimal point to the left of the least significant digit (9999.9). The least significant digit represents one tenth of an hour if the instrument is configured to record elapsed time. If the hour meter is configured to count pulses, the least significant digit represents one pulse. In the second display format the display has 5 seven-segment digits with a decimal point to the right of the least significant digit (99999.0). The least significant digit represents one hour if the instrument is configured in the run hour mode. The least significant digit represents one pulse counted when the instrument is configured in the pulse counter mode.

In operation in the run hour meter mode the instrument accumulates and displays elapsed time in a format determined by the display format option. Upon power up, the instrument retrieves the previously accumulated run time from non-volatile memory in the $E^2$PROM. When the enable clock/count input 31 is active the instrument accumulates and displays run hours. The display decimal point flashes for approximately 2.5 seconds on and 2.5 seconds off when the instrument is accumulating hours. When the enable clock/count input 31 is not active, the hour meter does not accumulate hours but displays the previously accumulated run hours. The decimal point on the display does not flash.

The hour meter has a maintenance timer feature. This feature is enabled if the maintenance timer limit in non-volatile memory is greater than zero. If the enable clock/count input 31 is active, the instrument accumulates run time and compares this time to the preprogrammed maintenance timer limit. If the accumulated time is greater than or equal to the maintenance timer limit the instrument flashes a warning pixel, such as a crescent wrench, to indicate that maintenance needs to be performed.

If the externally attached view switch 30 is pressed, the accumulated maintenance time since last reset is displayed in the display format selected. While the view switch 30 is pressed, the accumulated maintenance time is displayed and remains for five seconds after the view switch 30 is released.

If the externally attached view switch 30 is held pressed prior to power being applied and held pressed continuously for approximately 5 seconds after power up, the accumulated maintenance time is reset to zero. Upon power up if the PKO 28 is held low, the device goes into an infinite loop allowing for programming of the $E^2$PROM with an externally attached programmer. This allows one to program the maintenance time limit desired. The device operates normally upon removal of the external programmer.

In the pulse counter mode, the instrument functions as a pulse counter which accumulates and displays pulses counted in the display format selected. Upon power up, the instrument retrieves from non-volatile memory the previously accumulated pulses counted. The pulse counter input 21 is scanned at 1 millisecond intervals. If the input 21 is in the high state for 16 successive scans, the pulse is recognized as high. If the input 21 is in the low state for 16 successive scans, the pulse is recognized as low. One pulse is accumulated for a high-to-low recognized pulse transaction. If the externally attached view switch is pressed upon power up for five seconds, the accumulated pulses counted are reset to zero. If the master reset 29 is in the active state for 1 second the accumulated pulses counted shall be reset to zero. Upon power down, the instrument saves the accumulated pulse in non-volatile memory.

While the foregoing has been described with reference to its preferred embodiment, various alterations and modifications will occur to those skilled in the art. For example, the LCD display could be increased to display six digits or the flashing pixel could be a different shape. These and other modifications are intended to fall within the scope of the claims.

What is claimed:

1. A programmable elapsed time meter comprising:

an electronic circuit including means for calculating elapsed time, $E^2$PROM memory means having a plurality of registers for storing the calculated elapsed time, and means for continually updating the the stored calculated elapsed time in said plurality of registers such that no register is updated more than a preselected number of times until all the registers have been updated said preselected number of times;

input terminals for enabling said electronic circuit;

a liquid crystal display connected to said electronic circuit, capable of displaying the elapsed time stored in said electronic circuit; and a capacitor connected to said electronic circuit for supplying power to said electronic circuit to enable the electronic circuit to update the $E^2$PROM memory means at power shutdown.

2. The programmable elapsed time according to claim 1 wherein said electronic circuit is configured to measure and record pulses.

3. The programmable elapsed time meter according to claim 1 wherein said liquid crystal display displays five digits and a maintenance pixel.

4. The programmable elapsed time meter according to claim 3 wherein said electronic circuit can store a maintenance time limit and said electronic circuit compares the maintenance time limit with the elapsed time and flashes a warning pixel on said liquid crystal display if the recorded time is greater than or equal to the maintenance time limit.

5. The programmable elapsed time meter according to claim 4 wherein said electronic circuit can be configured to display 1 digit to the right of the decimal point.

6. The programmable elapsed time meter according to claim 3 further comprising a view switch input connected to said electronic circuit wherein said liquid crystal display will display the accumulated time for up to 5 seconds after said view switch input is engaged and the accumulated maintenance time will be reset to zero when said view switch input is engaged for 5 seconds upon powering up said circuit.

7. The programmable elapsed time meter according to claim 1 further comprising a housing wherein said liquid crystal display is visible through a face in said housing.

8. The programmable elapsed time meter according to claim 1 further comprising external connections from said electronic circuit to an alarm wherein said electronic circuit can store a maintenance time limit and said electronic circuit compares the maintenance time limit with elapsed time and if the elapsed time is greater than or equal to the maintenance time limit said electronic circuit activates the alarm through said external connection.

9. The programmable elapsed time meter according to claim 8 wherein said alarm is an audible buzzer.

10. The programmable elapsed time meter according to claim 8 wherein said alarm is a warning light.

11. The programmable elapsed time meter according to claim 1, wherein said means for writing the elapsed time into said plurality of registers is a programmable microcontroller.

12. The programmable elapsed time meter as set forth in claim 1, wherein said preselected number of times is ten-thousand times.

* * * * *